US010864395B2

(12) United States Patent
Murray et al.

(10) Patent No.: US 10,864,395 B2
(45) Date of Patent: Dec. 15, 2020

(54) WET-DRY FIRE EXTINGUISHING AGENT

(71) Applicant: Fireaway Inc., Minnetonka, MN (US)

(72) Inventors: Donald Murray, Green Bay, WI (US); Gonzalo Lopez-Davila, The Woodlands, TX (US); Anthony Gee, Minnetonka, MN (US)

(73) Assignee: Fireaway Inc., Minnetonka, MN (US)

( * ) Notice: Subject to any disclaimer, the term of this patent is extended or adjusted under 35 U.S.C. 154(b) by 189 days.

(21) Appl. No.: 16/011,448

(22) Filed: Jun. 18, 2018

(65) Prior Publication Data

US 2019/0038925 A1 Feb. 7, 2019

Related U.S. Application Data

(60) Provisional application No. 62/542,071, filed on Aug. 7, 2017.

(51) Int. Cl.

| | |
|---|---|
| ***A62C 31/00*** | (2006.01) |
| ***A62C 99/00*** | (2010.01) |
| ***A62C 5/00*** | (2006.01) |
| ***A62C 35/02*** | (2006.01) |

(52) U.S. Cl.

CPC ..... *A62C 31/005* (2013.01); *A62C 5/006* (2013.01); *A62C 99/0045* (2013.01); *A62C 99/0072* (2013.01); *A62C 5/008* (2013.01); *A62C 35/026* (2013.01)

(58) Field of Classification Search

CPC .... A62C 3/07; A62C 3/08; A62C 3/10; A62C 5/006; A62C 5/008; A62C 31/005; A62C 35/026; A62C 37/11; A62C 37/36; A62C 99/0009; A62C 99/0045; A62C 99/0072

See application file for complete search history.

(56) References Cited

U.S. PATENT DOCUMENTS

| | | | | |
|---|---|---|---|---|
| 4,643,260 A * | 2/1987 | Miller | A62C 3/08 169/46 |
| 5,799,735 A | 9/1998 | Sundholm | |
| 5,831,209 A | 11/1998 | Kozyrev et al. | |
| 5,845,714 A * | 12/1998 | Sundholm | A62C 3/00 169/46 |

(Continued)

FOREIGN PATENT DOCUMENTS

WO WO-2019032188 A1 2/2019

OTHER PUBLICATIONS

International Application Serial No. PCT/US2018/038134, International Preliminary Report on Patentability dated Feb. 20, 2020, 12 pgs.

(Continued)

*Primary Examiner* — Darren W Gorman

(74) *Attorney, Agent, or Firm* — Schwegman Lundberg & Woessner, P.A.

(57) ABSTRACT

Fire extinguishing systems and methods, such as for combating compartment fires, can include or use wet and dry agents such as water droplets and aerosol-based particulate extinguisher agents. In an example, an extinguishing system includes a centralized extinguishing controller that can selectively provide the wet and dry agents to a compartment or environment. In other examples, dedicated dispenser systems separately, but optionally concurrently, provide water and aerosol-based agents to combat a compartment fire.

20 Claims, 7 Drawing Sheets

(56) References Cited

U.S. PATENT DOCUMENTS

| | | | | |
|---|---|---|---|---|
| 5,865,257 | A | 2/1999 | Kozyrev et al. | |
| 5,918,680 | A | 7/1999 | Maranghides et al. | |
| 6,042,664 | A | 3/2000 | Kozyrev et al. | |
| 6,089,326 | A | 7/2000 | Drakin | |
| 6,116,348 | A | 9/2000 | Drakin | |
| 6,264,772 | B1 | 7/2001 | Drakin | |
| 6,689,285 | B2 | 2/2004 | Rusin et al. | |
| 7,066,274 | B2 * | 6/2006 | Lazzarini | A62C 3/08 169/16 |
| 8,733,463 | B2 * | 5/2014 | Meier | A62C 99/0018 169/46 |
| 2005/0000700 | A1 | 1/2005 | Sundholm | |
| 2006/0108559 | A1 | 5/2006 | Sharma et al. | |
| 2006/0278410 | A1 | 12/2006 | Reilly | |
| 2007/0007019 | A1 * | 1/2007 | Wierenga | A62C 35/11 169/30 |
| 2007/0044979 | A1 | 3/2007 | Popp et al. | |
| 2008/0319716 | A1 | 12/2008 | Golinveaux et al. | |
| 2010/0181081 | A1 | 7/2010 | Reilly et al. | |
| 2010/0294518 | A1 | 11/2010 | Lelic et al. | |
| 2012/0285710 | A1 | 11/2012 | Umehara | |
| 2014/0076586 | A1 * | 3/2014 | Lemke | A62C 99/0009 169/46 |
| 2014/0158382 | A1 * | 6/2014 | Ferguson | A62C 37/36 169/46 |
| 2016/0096051 | A1 | 4/2016 | Baker et al. | |

OTHER PUBLICATIONS

"International Application Serial No. PCT US2018 038134, International Search Report dated Sep. 13, 2018", 2 pgs.

"International Application Serial No. PCT US2018 038134, Written Opinion dayed Sep. 13, 2018", 10 pgs.

European Application No. 18844194.3, Response filed Jun. 10, 2020 to Communication Pursuant to Rules 161(2) and 162 EPC dated Mar. 17, 2020, 27 pgs.

* cited by examiner

WET-DRY FIRE EXTINGUISHING AGENT

CLAIM OF PRIORITY

This patent application claims the benefit of priority to U.S. Provisional Patent Application No. 62/542,071, filed on Aug. 7, 2017, which is incorporated by reference herein in its entirety.

BACKGROUND

Water sprinklers have traditionally been installed in buildings to control and extinguish fires. Other fire extinguishing systems, such as gaseous firefighting agents, have been developed for applications such as in engine rooms on ships, computer rooms, and electrical equipment rooms. Some popular gaseous systems used halon gases until production of such systems was terminated due to their adverse effects on the environment.

Each fire extinguishing agent has different performance characteristics and different application requirements. Some agents and systems include gaseous chemical agents similar to halons except that today's gaseous agents are engineered to have minimal detrimental effects on the environment. Other systems can use fine water spray or water mist, and still others can use aerosol agents, such as comprising fine particulate extinguisher matter. These various approaches have different mechanisms of extinguishing and suppressing fire, exhibit differences in performance depending on the circumstances of the fire and system, and further require or use different equipment to dispense the various agents.

Water spray systems generally extinguish by cooling. Such water systems discharge large amounts of water from open spray heads and, depending on the fire, the time to extinguish can be relatively long. Typically, these systems operate on pressures of 50 to 250 psi (344 to 1,723 kPa) and have water droplet sizes of over 200 μm diameter on average. The water can be supplied from standard fire mains in buildings or on ships, or from dedicated water storage vessels with a dedicated pump, or from other sources. Water systems can use fresh or salt water and may have additives, such as firefighting foam concentrates, to improve performance. In an example, water used can include additives to inhibit freezing, or can include a wetting agent or chemical sealant configured to seal a fuel surface from air to prevent re-flash.

Some agents proposed to replace halons are gaseous agents that resemble halons, including various chemical agents stored in pressurized tanks and discharged through valves and a pipe distribution system. The term "in-kind" is used in some cases to describe such gaseous agents because they resemble a halon agent and can have essentially the same or similar methods of application and storage. Although similar to halons, which interrupt the chemical reaction of a fire, gaseous replacements generally use cooling as their main extinguishing mechanism. One well-recognized halon replacement agent is heptafluoropropane, or HFC-227ea.

Various gaseous agents convert to a gas when discharged and are engineered to leave little to no residue from the agent itself. Nonetheless, in the process of extinguishing a fire, some agents decompose into highly toxic and aggressive acid gases, such as hydrogen fluoride (HF), when exposed to fire or high temperatures. If a fire is particularly large or high-energy, such as can occur in an engine room of a marine vessel, or in a storage area for fuels or flammable liquids, then there can be a significant potential for injury or damage to equipment from the extinguishing agent. Further, the presence of acid gases can compromise fire fighters' ability to further combat a fire. Some gaseous agents require an increase in a mass of the agent needed to be stored and installation costs can be higher than for a halon system.

In combating very large or difficult fires, dangerous levels of HF byproduct can be produced. In some examples, an extinguishing system can provide a water mist followed by a fire extinguishing mixture that includes a diluent gas and a fluorocarbon extinguishing agent. The purpose of the water discharge is to reduce the toxic HF gas in the atmosphere.

Improved water-based systems also followed the discontinuation of halon systems. Water deluge systems have long been used to extinguish fires, primarily by cooling a designated area. Such water-based systems are configured to discharge large amounts of water from, e.g., overhead spray heads. Depending on a fire's size and type of fuel burning, among other factors, a time needed to extinguish a fire using a water-based system can be several minutes or more.

Variations in water systems include fine water spray systems with droplet sizes approaching 200 μm diameter on average, and water-misting systems with droplets below 200 μm. Water systems are generally more effective with smaller droplets but the performance results show that these systems, while suitable for very large fires, are less effective on small and/or obstructed fires. Even the standards for the testing and approval of these systems typically expect the extinguishing times for the misting systems with very fine droplets to take 10 to 15 minutes, and additional nozzles can be required to overcome obstructions. Furthermore, water-based systems are often not sufficiently effective at flooding a large compartment or a compartment with obstructions. Although an overall extinguishing performance of water-based systems is not attractive, it is generally seen that a water spray or mist system can reduce compartment temperatures and provide a significant measure of control, although not always capable of achieving complete extinguishment.

SUMMARY

Systems and methods discussed herein are configured for suppressing a fire event in a chamber or compartment. For the purposes of this disclosure, fire suppression can include one or more of extinguishing, controlling, mitigating, or otherwise decreasing effects or presence of a fire in a compartment or elsewhere. The systems and methods discussed herein can include a hybrid system that uses multiple agents, such as wet and dry agents, for example including water and aerosol agents, to suppress a fire.

In an example, a method for suppressing a fire using the systems described herein can include conditioning a chamber environment having a fire event. Conditioning the chamber environment can include dispensing a liquid mist, such as a water vapor or mist, into the chamber environment, to thereby reduce temperature stratification throughout at least a portion of the chamber environment by cooling the chamber environment using the dispensed liquid mist. The method can further include suppressing the fire event in the chamber environment. Suppressing the fire event can include dispensing an aerosol fire suppression agent into the chamber environment when the chamber environment includes at least a portion of the dispensed liquid mist, and thereby diminishing the fire event in the chamber environment using the dispensed aerosol fire suppression agent. In an example, diminishing the fire event or extinguishing the fire is enhanced due at least in part to the cooled chamber environment and the dispensed liquid mist. In an example, the conditioning the chamber environment using the liquid and the suppressing the fire event using the aerosol agent occurs substantially concurrently.

This Summary is intended to provide a brief overview of subject matter of the present application. It is not intended to provide an exclusive or exhaustive explanation of the invention or inventions discussed herein. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
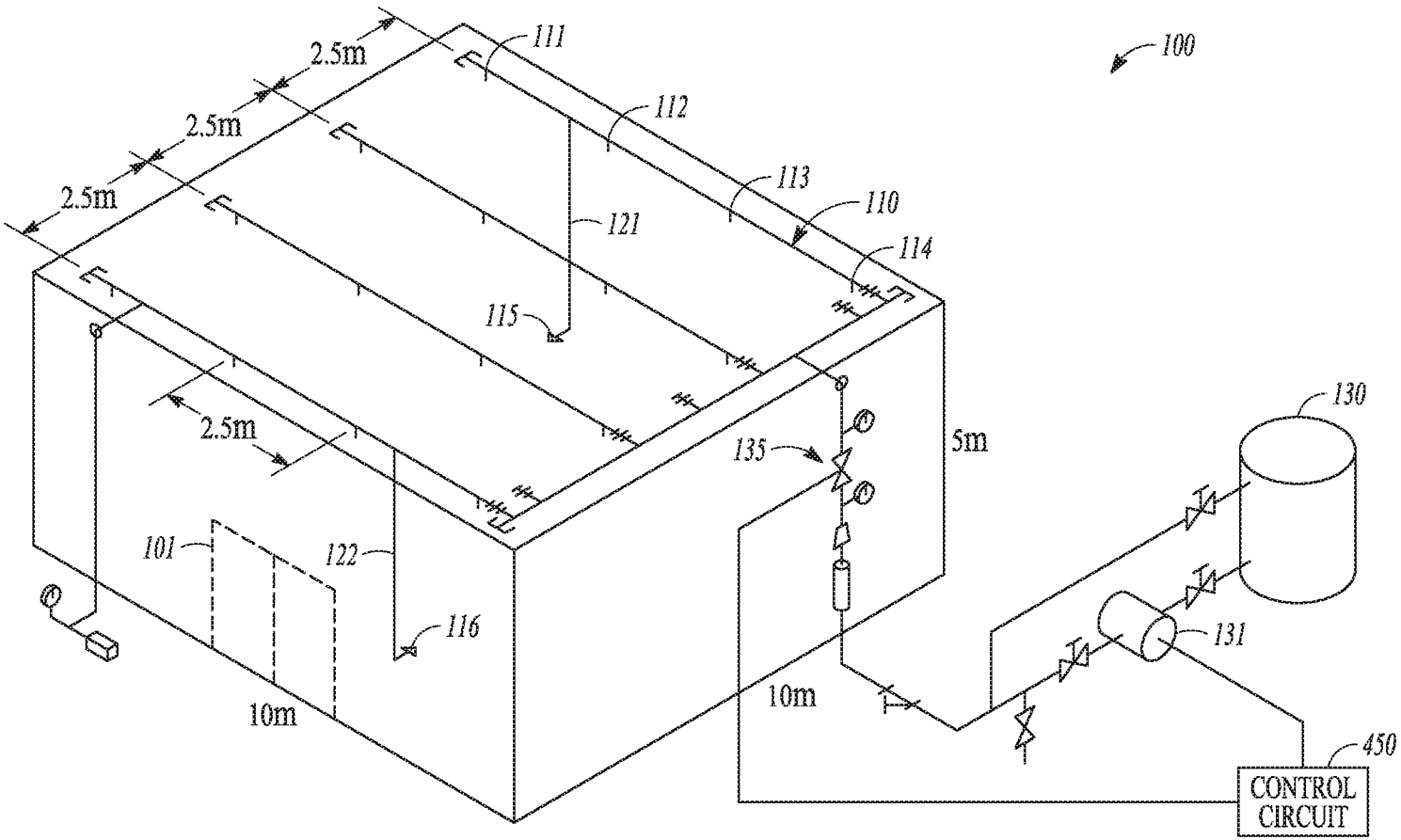
FIG. 1 illustrates generally a schematic perspective view of a fire test facility.

Systems and methods for fire suppression or fire extinguishing can include water-based systems, gas-based systems, and aerosol-based systems, among others. Although overall fire suppression performance of water-based systems is generally inferior to gas-based and aerosol-based systems, water-based systems are recognized to help control fires or reduce temperatures in compartments experiencing a fire event.

An aerosol extinguishing agent can have properties and characteristics that are distinct from water or gas-based extinguisher agents. For example, an aerosol can be a colloid of micro-particles, very fine solid particles or liquid droplets, such as suspended in air or suspended in another gas. In an example, an aerosol agent includes ultra-fine dry particles, typically under 5 μm in diameter on average, and can provide improved extinguishing performance per unit volume of agent discharged relative to, for example, a gas extinguisher. Such aerosol agents extinguish principally by interrupting the chemical chain reaction of a fire. Unlike water-based agents, fine particulate aerosol agents can have three-dimensional flooding characteristics, which can be more effective in overcoming obstacles than water alone.

An aerosol agent can be provided using an aerosol generator, such as by combusting a portion of a solid material inside a generator device and then discharging a cloud of the agent, such as can include the solid particulate along with a gaseous carrier component (e.g., nitrogen). This type of system is a pyrotechnic aerosol or a condensed aerosol system. Alternatively, an aerosol agent can include a particulate agent that is provided in a pressurized container, such as together with a carrier gas (e.g., nitrogen). Such an agent stored in a pressurized container, sometimes referred to as a dispersed aerosol, can be similar to a common fire extinguisher and could be discharged through valves and pipes.

Aerosol-based systems can be less effective as a height of a compartment or enclosure protected by such systems increases. The reduced effectiveness can be attributed, at least in part, to the relatively warm temperature of the agent being discharged. Dispensed aerosol agents can stratify or disperse throughout a compartment or enclosure, with an amount of agent available at a lower portion of the compartment being less than desired for effective or complete extinguishment, at least under initial dispensing conditions. Fire extinguishing performance with aerosols can be improved by increasing an amount of agent used, increasing a rate of discharge, and/or by locating one or more aerosol generators at different altitudes, heights or locations in a compartment.

The present inventors have recognized that a problem to be solved includes providing efficient and effective fire control and extinguishment for a compartment fire. The problem can include eliminating or reducing an amount of fire-inhibiting or fire-extinguishing agent to be used. The problem can further include eliminating or reducing an amount of toxic or hazardous byproducts from a fire extinguishing system. The problem can further include ensuring or encouraging a more even distribution of aerosol extinguisher agents, for example, in large or tall compartments or in compartments that include one or more obstructions.

The present inventors have recognized that a solution to these problems includes combating a fire event in a compartment by discharging an aerosol agent into the compartment or hazard area in combination with discharging a liquid, such as water, into the same compartment or hazard area. The combination of aerosol agent and water, as shown in the test data presented herein, is more effective than water-only and aerosol-only systems in rapidly distributing the aerosol agent in a compartment, thereby reducing a time to extinguish fires, and reducing an amount of aerosol agent consumed. The solution can further include a control system that can be configured to discharge one or both of water-based and aerosol-based extinguishing agents, such as based on temperature information or other information from sensors in a protected compartment, or by manual initiation. The solution can further include a control system that can operate or initiate the water-based and/or aerosol-based extinguishers independently and/or concurrently.

Some fire extinguishing approaches using both gaseous and water systems use water to substantially reduce a compartment temperature and use a large amount of gaseous agent, such as an amount that would be sufficient to extinguish a fire if the gas agent was used exclusively. Some gaseous and water systems use a deluge of water to scrub or help remove toxic gases from a protected compartment, but the water itself is generally not helpful to the extinguishment performance of the system.

In contrast with such a gas-based extinguisher agent approach, the present systems and methods include using a wet and dry agent together, such as including using an amount of water sufficient to regulate or homogenize temperatures in a compartment, but optionally without a substantial reduction in temperature. Further, any water droplets in the room can have a net downward momentum which can assist the aerosol particles in reaching lower elevations where a fire is more likely to originate. The various aerosol-based agents discussed herein or contemplated for use with the present hybrid system do not include or produce toxic gases and accordingly the byproducts need not be removed from the air.

The data presented herein show a marked improvement in fire extinguishment using the water-and-aerosol system as compared to approaches that use water mist only or aerosol only. The water-and-aerosol systems discussed herein are sometimes referred to as a hybrid system, or as a wet and dry system. Since the hybrid system extinguishes some fires that are not extinguished by either water mist or aerosol alone, such as demonstrated by the data in FIGS. 5 and 6, the hybrid system represents a different kind or type of system than others that may use only one means of extinguishment or may use other combinations of extinguishment means. That is, the improvement in fire extinguishment exhibited by the present systems and method indicate that the improvement is not one of merely a degree of difference but rather one of a different kind of performance.

The wet and dry, or water and aerosol, systems described herein use each of water and aerosol agents to realize enhanced fire extinguishing performance. The present inventors have recognized, for example, that when water and aerosol systems are combined, water dispensed into a hazard area does not scrub, or cause to precipitate out of the atmosphere, a dispersed aerosol agent from the same hazard area. That is, the inventors recognized that the presence of water in the atmosphere does not cause aerosol particles to be removed from, or to be less effective at fire extinguishment in, the atmosphere in the hazard area such as when a fire event is occurring. The inventors recognized that each of the water and aerosol agents provides various functions independently, and that a combined effect of the agents is an improvement in fire extinguishment over either agent used alone.

The water and aerosol systems can be configured to discharge their respective agents simultaneously, or one can be discharged before the other. In an example, a water system is configured to discharge water into a compartment before an aerosol system discharges an aerosol agent into the compartment. In this configuration, the discharged water can cool the compartment, at least in part, before the aerosol agent is introduced. The water alone may extinguish at least a portion of some fires, but may not extinguish all fires, such as including obstructed fires. The extinguishing performance and cooling performance may vary with the amount of water released, water droplet size, water release location, or water pressure at discharge, among other factors. Generally, less water and/or larger droplet sizes reduces performance in cooling and extinguishing.

In an example, dispensing water as a spray (e.g., including water droplets having an average diameter of about 200 μm or more) or mist (e.g., including water droplets having an average diameter of about 200 μm or less) can help homogenize atmospheric conditions in a compartment and reduce temperature stratification in the compartment. That is, the dispensed water can help reduce temperature differences that may exist horizontally and/or vertically throughout a compartment.

Following release of the water spray or mist, temperatures throughout a compartment can be more homogenous, and the compartment can be considered conditioned for more optimal dispersion of an aerosol agent. That is, without the temperature stratification in the compartment, aerosol particles released into the atmosphere of the compartment can better disperse or distribute throughout the compartment. By reducing the temperature stratification, an aerosol agent can more effectively reach all areas of the compartment, including lower elevations or partially-obstructed areas. That is, the aerosol discharge can overcome, or distribute around, various obstacles (e.g., under tables, behind equipment, etc.) inside of a protected compartment. In an example, under cooled and/or more humid environmental conditions, an aerosol agent density at lower elevations can be improved, and a dispensed aerosol agent may be able to overcome obstacles more quickly and thus become significantly more efficient and effective in extinguishing otherwise difficult fires. As seen in the data presented herein, when an aerosol agent is used together with water to combat a compartment fire, the combined system is more effective than a water-only or aerosol-only system in combating obstructed and non-obstructed fires.

In an example, an aerosol system is configured to discharge an aerosol agent into a compartment before a water system discharges water into the compartment. In this configuration, the aerosol agent can help extinguish at least a portion of any active fires. However, due at least in part to temperature stratification in the compartment, the aerosol agent may not adequately or completely extinguish all fires, such as smaller fires, obstructed fires, or fires occurring at relatively lower elevations inside the compartment. For example, aerosol particles can be relatively hot at the time they are generated or released, and when such hot particles are dispensed into a relatively hot compartment, a density of the particles at higher elevations can be greater than at lower elevations in the compartment.

Following release of the aerosol agent, the water system can discharge water spray or mist into the compartment. Following introduction of the water into the compartment, the compartment can be cooled by the water, and temperature differences or stratification throughout the compartment can be reduced. As a result, aerosol particles can more readily distribute throughout the compartment, leading to a more homogenous distribution of aerosol fire extinguishing matter throughout the environment. Aerosol concentrations at lower elevations or around obstructions is thus improved after introduction of water to the compartment.

In an example, aerosol and water systems are configured to discharge their respective agents substantially simultaneously. When released simultaneously, the benefits of each system are substantially realized, including the cooling effects of the water, better dispersion of released aerosol agent, and fire extinguishing effects of the aerosol agent.

Generally, an order in which the water and aerosol systems are actuated, or a delay between actuation of the two systems, does not significantly alter the result of a better-performing fire extinguishment system over either one of the systems acting independently. Selecting or programming an order in which to actuate the systems can depend on various factors including, among other things, a configuration of the compartment to be protected, a presence of obstructions, a detected location of a fire event relative to, e.g., water nozzles or aerosol dispensers, or a detected temperature stratification inside of the compartment.

Various effects and benefits of the combined water and aerosol extinguishing system are illustrated herein in the form of test data obtained from controlled fire testing in a test facility. Tests were performed using fuel pans in accordance with marine standard IMO MSC.1/Circular 1270 and filled with n-heptane fuel. FIGS. 1-4 illustrate generally schematic examples of the test facility and extinguishing systems configurations.

FIG. 1 illustrates generally a schematic perspective view of a fire test facility 100. The facility 100 includes a generally rectangular cuboid compartment having a volume of about 550 cubic meters. The facility 100 has a length of about 10 meters, a width of about 10 meters, and a height of about 5 meters. The facility 100 includes an entry door 101 that can be closed or sealed during fire test events. The facility 100 includes one or more fire test pans, and the fire test pans are illustrated in subsequent ones of the figures. Other configurations can similarly be used for testing or verification of the systems and methods discussed herein.

The example of FIG. 1 illustrates generally an example of a water discharge system 110 installed inside the fire test facility 100. The water discharge system 110 includes water dispensing nozzles at various locations throughout the facility 100, including at different elevations. For example, the water discharge system 110 includes sixteen nozzles substantially evenly distributed in a grid array near a ceiling of the facility 100. A first branch of the water discharge system 110 supplies water to first through fourth nozzles 111, 112, 113, and 114. In the example of FIG. 1, the water discharge system 110 includes second and third branches 121, 122, that extend to respective fifth and sixth nozzles 115, 116, spaced away from the ceiling. In the example of FIG. 1, the fifth and sixth nozzles 115, 116 are located about 3 meters from the ceiling. Other configurations can similarly be used.

In an example, a water supply for the water discharge system 110 can include standard supply mains as would be similarly available in buildings or on ships, or can include a water storage tank or reservoir. In the example of FIG. 1, the water discharge system 110 is coupled to a water reservoir 130. Water from the water reservoir 130 can be pumped to the water discharge system 110 using a pump 131 and/or a flow control valve 135. In an example, the pump 131 is configured to maintain the water discharge system 110 at pressures of about 50 to 250 psi (344 to 1,723 kPa), and the system can provide water spray in droplets having average diameters greater than about 200 μm. In an example, the pump 131 includes a high-pressure pump, such as can operate at pressures of about 250 psi to 2,000 psi or higher (1,723 to 13,790 kPa) to create a fine mist, e.g., providing droplets under 200 μm in diameter. Such systems can use fresh water, deionized water, or salt water, and the water may or may not have additives, such as firefighting foam concentrates, to enhance extinguishing performance.

The pump 131 and the flow control valve 135 can be coupled to a control circuit 450, and the control circuit 450. The control circuit 450 can be configured to control an open/closed status of the flow control valve 135, and/or to control a speed or throughput of the pump 131. Various additional filters, pumps, valves, flow controllers, meters, or other devices can be provided at various locations or branches of the water discharge system 110 to further control or meter water dispensing at various locations throughout the facility 100.

In an example, the nozzles of the water discharge system 110 can each be configured similarly or differently. That is, some nozzles can be configured to release a different amount of water than other nozzles.

Figure 2:
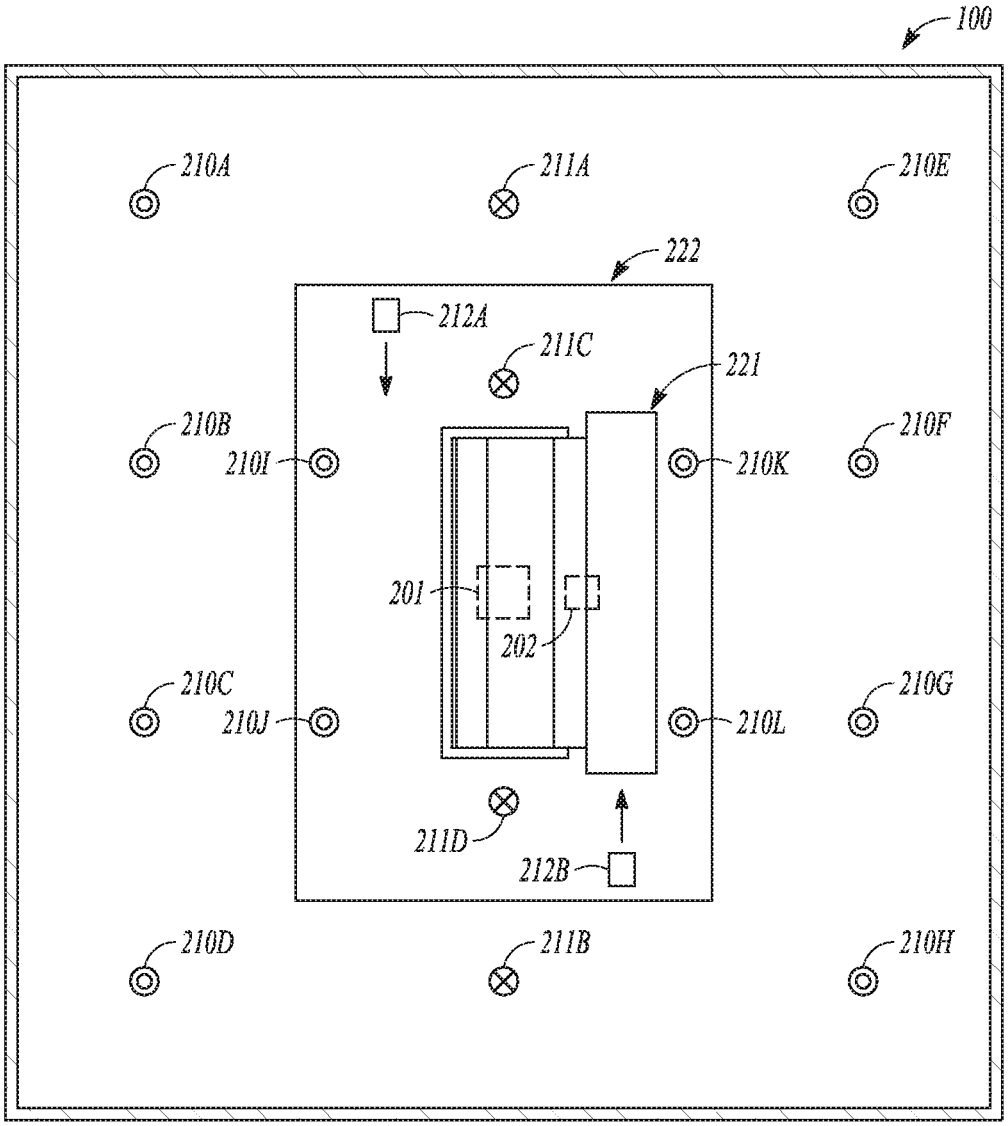
FIG. 2 illustrates generally a schematic top view of the fire test facility.

FIG. 2 illustrates generally a schematic top view of the fire test facility 100. The view of FIG. 2 shows the locations of first and second fuel pans 201 and 202, aerosol generators 210A-210L, 211A-211D, 212A, and 212B, and at least first and second obstructions 221 and 222.

In the example of FIG. 2, the first and second fuel pans 201 and 202 have different dimensions and are located at different elevations within the fire test facility 100. The first fuel pan 201 is 0.25 square meters and holds a first amount of fuel (e.g., n-heptane or similar) and the second fuel pan 202 is 0.1 square meters and holds a different second amount of fuel (e.g., n-heptane or similar).

The first and second obstructions 221 and 222 are selected to conform with International Maritime Organization standard MSC.1/Circular 1270 that defines guidelines for testing and approval of fixed extinguishing systems for machinery spaces. In the present example, the first and second obstructions 221 and 222 are configured to mimic or represent various components of an engine in an engine room of a marine vessel. Other obstructions or configurations of obstructions can be similarly used to test the systems and methods discussed herein.

FIG. 2 further illustrates locations of various aerosol generators inside the fire test facility 100. In the example of FIG. 2, different types of aerosol generators are provided at different locations inside the fire test facility 100. For example, first aerosol generators 210A-210L are provided at various locations near the ceiling of the fire test facility 100. The first aerosol generators 210A-210L can include, for example, Stat-X® 2500-E generators, such as can include an aerosol-forming chemical pellet with a nominal mass of 2500 grams and nominal discharge time of about 36 seconds. In the example of FIG. 2, second aerosol generators 211A-211D can be provided at various other locations in the fire test facility 100, such as near the first and/or second obstructions 221 and 222. The second aerosol generators 211A-211D can include, for example, Stat-X® 1500-E generators, such as can include an aerosol-forming chemical pellet with a nominal mass of 1500 grams and nominal discharge time of about 23 seconds. In the example of FIG. 2, third aerosol generators 212A and 212B can be provided at other locations in the fire test facility 100, such as under the second obstruction 222. The third aerosol generators 212A-212B can include, for example, Stat-X® 2500-E generators. Other aerosol generators or aerosol-releasing devices can similarly be used.

Various aerosol-based extinguishers can be used according to the described systems and methods. For example, pyrotechnically-generated aerosols can be used, or non-pyrotechnically-generated aerosols can be used. In an example, the various aerosol extinguishers, aerosol generators, or systems configured to use an aerosol extinguisher, such as described in one or more of the following patent or publication documents, can be used with the water discharge system 110 to realize some or all of the benefits described herein: U.S. Pat. No. 7,614,458, "Ignition Unit for Aerosol Fire-retarding Delivery Device"; U.S. Pat. No. 7,461,701, "Aerosol Fire-retarding Delivery Device"; U.S. Pat. No. 7,389,825, "Aerosol Fire-retarding Delivery Device"; U.S. Patent Application Publication No. 2007-0039744, "Tunnel Fire Protection System"; U.S. Patent Application Publication No. 2007-0079972, "Manually Activated, Portable Fire-extinguishing Aerosol Generator"; U.S. Patent Application Publication No. 2007-0068683, "Manually Activated, Portable Fire-extinguishing Aerosol Generator"; U.S. Patent Application Publication No. 2007-0068687, "Manually Activated, Portable Fire-extinguishing Aerosol Generator Having a Plurality of Discharge Ports Circumferentially Disposed About the Surface of the Casing"; U.S. Pat. No. 7,832,493, "Portable Fire Extinguishing Apparatus and Method"; U.S. Pat. No. 9,227,096, "Fire Suppression Apparatus and Method for Using the Same in an Enclosed Compartment"; U.S. Pat. No. 9,092,966, "Dual Release Circuit for Fire Protection System"; U.S. Patent Application Publication No. 2016-0346577, "Aerosol Fire Extinguishing Device for Installation on Moving Object, and Aerosol Fire Extinguishing Agent for use in Same". Other aerosol extinguishers, aerosol generators, or systems configured to use an aerosol extinguisher, can similarly be used.

Figure 3:
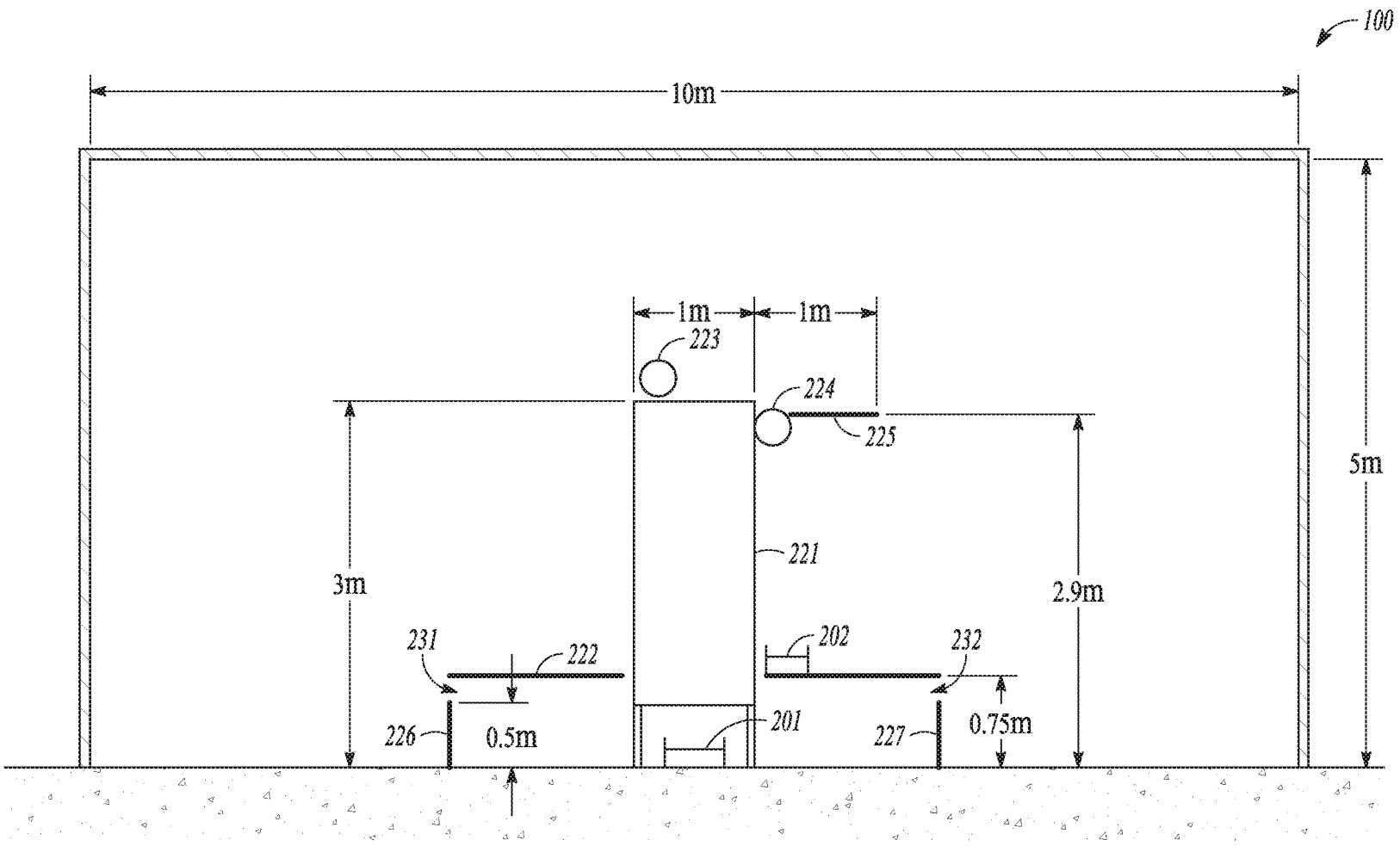
FIG. 3 illustrates generally a schematic side view of the fire test facility.

FIG. 3 illustrates generally a schematic side view of the fire test facility 100. In the example of FIG. 3, the various features of the water discharge system 110 and the various aerosol generators 210A-210L, 211A-211D, 212A, and 212B, are omitted for clarity of the other illustrated features.

In the example of FIG. 3, the first obstruction 221 generally includes a metal box that is configured to represent or simulate an engine block on a marine vessel. The second obstruction 222 generally includes a planar barrier (e.g., table surface) located about 0.75 meters from the floor of the fire test facility 100. Third and fourth obstructions 223 and 224 include metal tubes that are configured to represent exhaust manifolds for the simulated engine. A fifth obstruction 225 includes an elevated planar barrier located about 2.9 meters from the floor of the fire test facility 100. The fifth obstruction 225 acts as a canopy over the second fuel pan 202. In an example, when water nozzles or aerosol generators are located at a ceiling, the fifth obstruction 225 acts as an obstruction between the ceiling-based generators and any fire thereunder. Thus the configuration of obstructions is selected to test flooding characteristics and gas-like behavior of the fire suppressant agent(s) under test.

The first fuel pan 201 is provided under a portion of the first obstruction 221. At least the first and second obstructions 221 and 222 act as a canopy or partial cover over the first fuel pan 201. Sixth and seventh obstructions 226 and 227 are provided as sidewalls that further obstruct access to the first fuel pan 201. First and second air passages 231 and 232 are provided between an underside of the second obstruction 222 and the sidewalls or sixth and seventh obstructions 226 and 227. The first and second air passages 231 permit some atmospheric or gas communication between an underside of the first and second obstructions 221 and 222 and the rest of the fire test facility 100.

Various nozzles or outlets of the water discharge system 110 and/or of the aerosol generators 210A-210L, 211A-211D, 212A, and 212B, can be provided under the second obstruction 222. For example, at least water nozzles coupled to the second and third branches 121 and 122 of the water discharge system 110 can be configured to dispense water under the second obstruction 222. Additionally, the third aerosol generators 212A and 212B can be configured to dispense aerosol material under the second obstruction 222.

Figure 4:
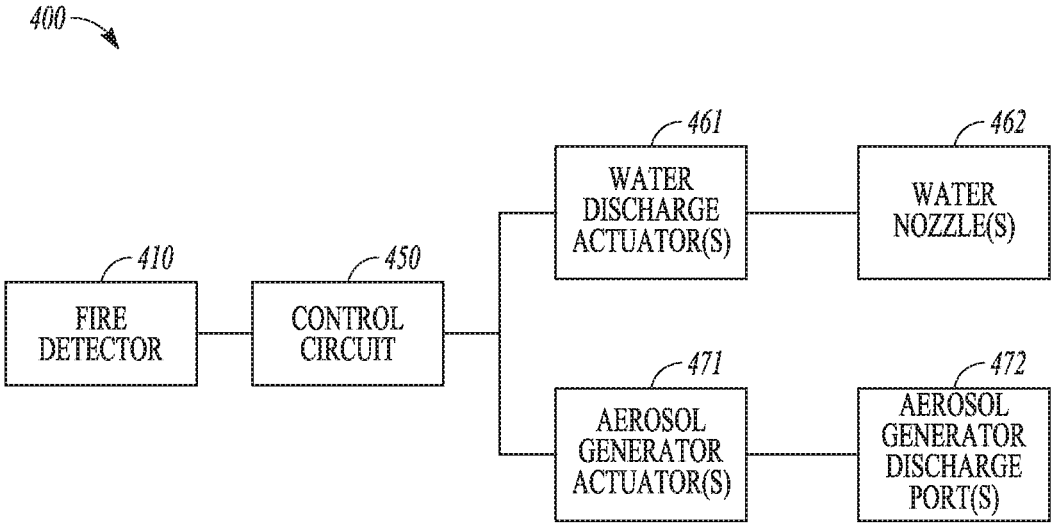
FIG. 4 illustrates generally a schematic example of a control system for a dual agent fire extinguishing system.

FIG. 4 illustrates generally a schematic example of a control system 400 for a dual agent fire extinguishing system. The control system 400 includes a fire detector 410, a control circuit 450, water discharge actuator(s) 461, water nozzle(s) 462, aerosol actuator(s) 471, and aerosol generator discharge port(s) 472.

The fire detector 410 can include various sensors or other means for detecting a presence of an active fire or fire event, or for detecting an elevated compartment temperature or other characteristic indicative of a fire event. In an example, the fire detector 410 includes a smoke detector (e.g., comprising an ionization and/or photoelectric sensor), a heat detector, an optical sensor such as an infrared sensor, or other sensor.

In the example of FIG. 4, the fire detector 410 is coupled to the control circuit 450. Information from the fire detector 410 can be provided to the control circuit 450. In response to the information from the fire detector 410, the control circuit 450 can coordinate a response that can include actuating various fire suppression systems and/or activating an audible or visible alarm. In an example, the control circuit 450 receives information from one or more other sensors (not shown in the example of FIG. 4) that provide information to help the control circuit 450 determine whether a fire event exists, and determine an appropriate response.

In the example of FIG. 4, the control circuit 450 is coupled to water discharge actuators 461 for the water discharge system 110. The water discharge actuator(s) 461 can include, among other things, valves, pumps, or other means for regulating fluid flow to one or more water nozzles 462. In an example, the water discharge actuator(s) 461 can include a single actuator that coordinates water release from multiple different ones of the water nozzles 462, or each of the water nozzles 462 can be controlled by a respective different one of multiple water discharge actuators 461.

The control circuit 450 is coupled to aerosol generator actuator(s) 471 for aerosol generator devices. The aerosol generator actuator(s) 471 can include, among other things, pyrotechnic mechanisms for initiating production and release of aerosol particulate matter through the aerosol generator discharge ports 472. In an example, the aerosol generator actuators 471 can include a single actuator that coordinates aerosol generation from multiple different aerosol generator devices, or each different aerosol generator device can be controlled by a respective different one of the aerosol generator actuators 471. In an example, different ones of the aerosol generator actuators 471 can be used to control aerosol generation in different zones or regions of a protected compartment. For example, a first aerosol actuator can be configured to initiate aerosol generation by the first aerosol generators 210A-210L, a second aerosol actuator can be configured to initiate aerosol generation by the second aerosol generators 211A-211D, and a third aerosol actuator can be configured to initiate aerosol generation by the third aerosol generators 212A and 212B.

In an example, the control circuit 450 is configured to determine a location or severity of a fire event and coordinate a response using the water discharge system 110 and/or an aerosol system, such as in one or more different protected compartments. That is, the control circuit 450 can be a centralized controller that is configured to monitor sensors or fire detectors 410 in multiple different compartments and coordinate respective responses.

In an example, the control circuit 450 is configured to monitor temperature information throughout a particular compartment and coordinate a water release from the particular ones of the water nozzles 462 that are positioned to most effectively cool or condition the compartment environment. In an example, the control circuit 450 includes a timer circuit configured to time durations between various triggering events. For example, following a specified water discharge duration or volume, or following a determination by the control circuit 450 that the compartment is sufficiently conditioned or temperature-regulated, the control circuit 450 can initiate the aerosol generator actuators 471. That is, the control circuit 450 can be configured to initiate an initial response to a fire event by the water discharge system 110, monitor the results of the initial response, and then initiate a subsequent response to the fire event using the aerosol generator actuators 471 to achieve more rapid extinguishment.

In an example, the control circuit 450 can be configured to determine a temperature profile for a protected environment, such as using temperature information for multiple different areas of the environment. Based on the temperature profile, and optionally based on information about a type of fire detected and/or features of or obstacles in the environment itself, the control circuit 450 can initiate a first response using the water discharge system 110. After a specified duration elapses or after dispensing a specified volume of water into the environment, the control circuit 450 can update the temperature profile and assess whether further conditioning is needed to maximize an efficacy of subsequent fire extinguishment using an aerosol agent. In an example, if the updated temperature profile indicates a sufficiently homogenous temperature profile for the environment, that is, reduced temperature stratification or differences throughout the environment, then the control circuit 450 can initiate release of an aerosol agent using one or more of the aerosol generator actuators 471.

As similarly discussed elsewhere herein, the water discharge system 110 can be initiated or used to release water into a protected compartment before, after, or concurrently with release of an aerosol fire extinguisher into the same compartment. That is, the control circuit 450 can be configured to initiate an initial response to a fire event using one or more aerosol generators (e.g., aerosol generators 210A-210L, 211A-211D, 212A, and 212B), monitor the results of the initial aerosol-based response, and then initiate a subsequent response to the fire event using the water discharge system 110 to achieve more rapid extinguishment.

Figure 5:
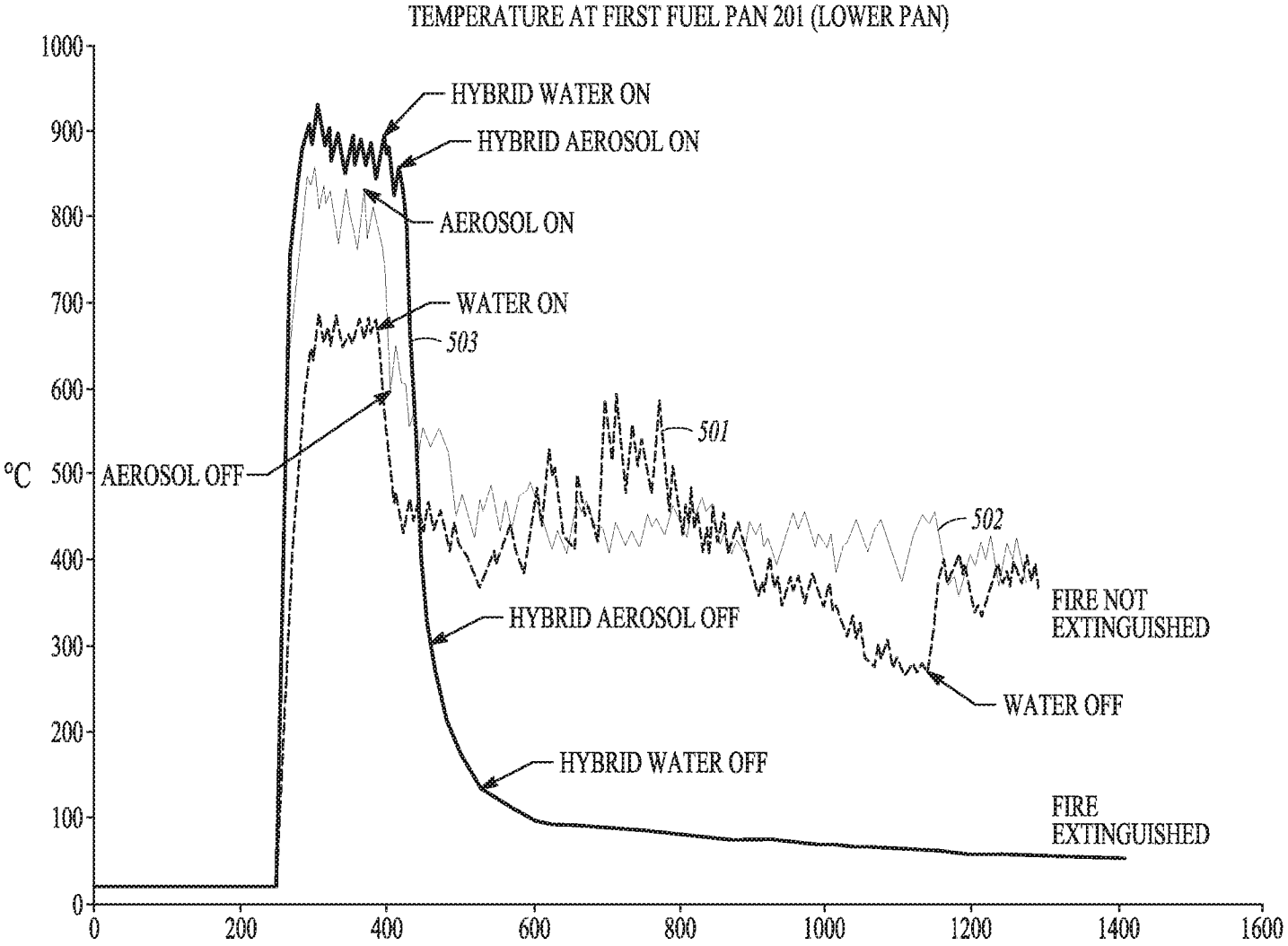
FIG. 5 and FIG. 6 illustrate generally test data acquired from the fire test facility for multiple different fire events.
Figure 6:
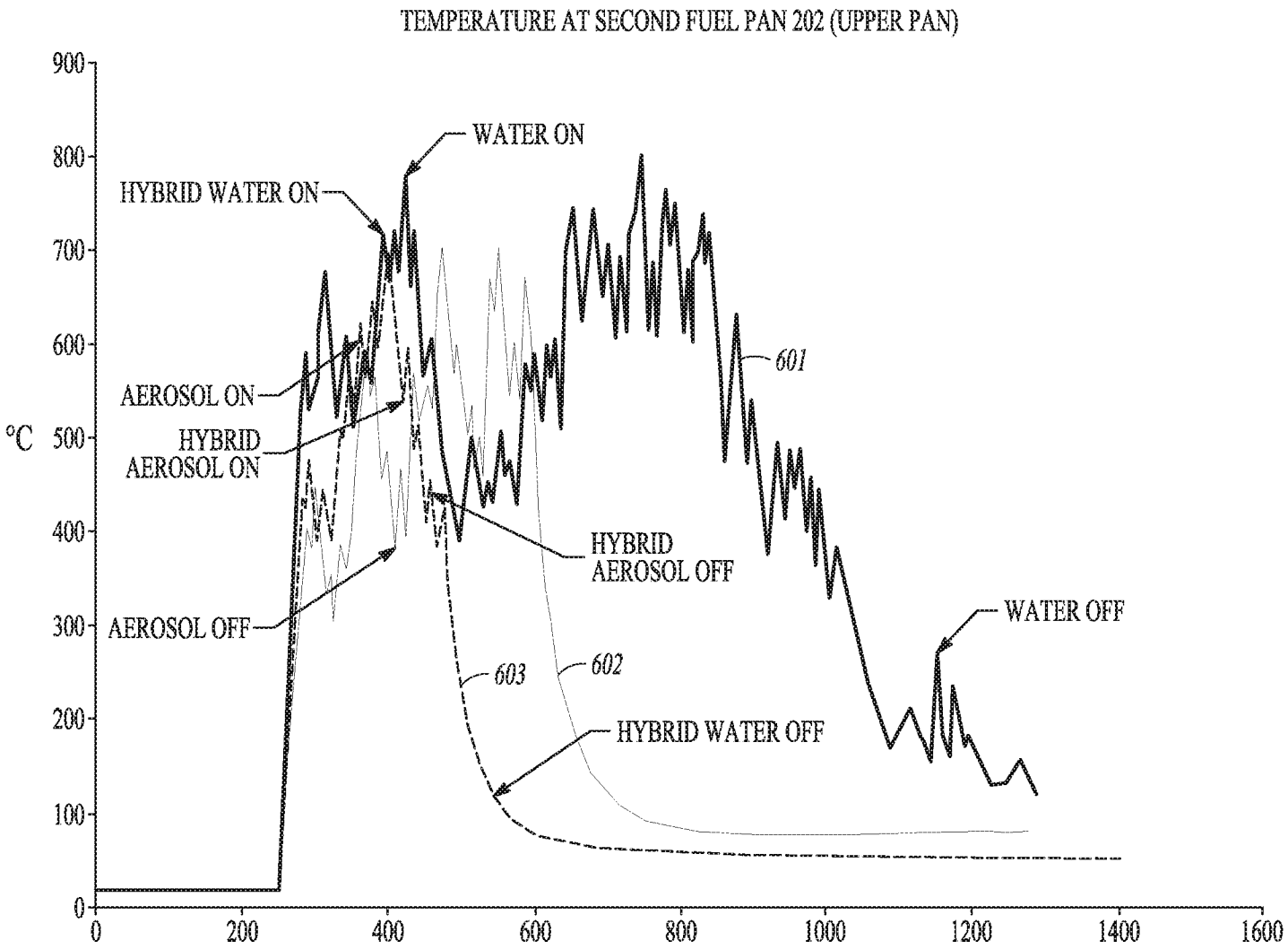

FIG. 5 and FIG. 6 illustrate generally test data acquired from the fire test facility 100 for multiple different fire events. The fire events include fires provided simultaneously in each of the first and second fuel pans 201 and 202. Temperature information near each of the pans was recorded to monitor the status of the different fire events. FIG. 5 illustrates generally temperature over time in the fire test facility 100 near the first fuel pan 201 when the first fuel pan 201 is provided under the simulated engine (see, e.g., FIGS. 2 and 3 showing the relative locations of the first and second fuel pans 201 and 202 with respect to the fire test facility 100). FIG. 6 illustrates generally temperature over time in the fire test facility 100 near the second fuel pan 202 when the second fuel pan 202 is provided adjacent to the simulated engine. The first fuel pan 201 is substantially obstructed by the various barriers and obstacles in the fire test facility 100, and the second fuel pan 202 is partially sheltered by an overhang.

Each of FIG. 5 and FIG. 6 includes data from several different fire test events. In FIGS. 5 and 6, first traces 501 and 601 correspond to temperatures over time for a first test event when only the water discharge system 110 is used to address the fires in the first and second fuel pans 201 and 202, respectively. Second traces 502 and 602 correspond to temperatures over time for a second test event when only an aerosol system is used to address fires in the first and second fuel pans 201 and 202, respectively. Third traces 503 and 603 correspond to temperatures over time for a third test event when aerosol and water systems are used together to address fires in the first and second fuel pans 201 and 202, respectively.

In the first, second, and third test events, the water discharge system 110 included the arrangement shown in the example of FIG. 1, operated at approximately 35 psi and configured to discharge about 20 gallons per minute. There were no additives, such as other fire extinguishing compounds or materials, in the water. The aerosol discharge system was configured to discharge up to about 100 grams of aerosol matter per cubic meter of the compartment or facility.

In the examples of FIGS. 5 and 6, data corresponding to the first traces 501 and 601 were acquired substantially simultaneously, during a first test event. The first test event thus included a fire event that was addressed using a wet constituent, i.e., water, only. Data corresponding to the second traces 502 and 602 were acquired substantially simultaneously during a different second test event. The second test event included a fire event that was addressed using a dry constituent, i.e., aerosol particulate matter, only. Data corresponding to the third traces 503 and 603 were acquired substantially simultaneously during a different third test event. The third test event thus included a fire event that was addressed using both wet and dry constituents, that is, using water and aerosol together to address the pan fires. The data represented by the various traces in FIGS. 5 and 6 is overlaid and time-aligned to best illustrate a duration between fuel pan ignition and extinguishment for each test event.

Flame temperatures approach or exceed 1000 degrees Celsius for each of the fire test events and at each of the first and second fuel pans 201 and 202. An amount of fuel used for each test is the same. Peak temperatures illustrated in FIGS. 5 and 6, such as prior to activation of a fire suppression system, vary due to environmental differences at the time of each test. For example, an absolute temperature value at a fuel pan can vary due to several manual processes involved in the test protocol. Such manual processes can include closing the test chamber door, closing the building vents, natural ventilation air drafts, positioning of a thermocouple at the fuel pan, total pre-burn time prior to activation, and test chamber ambient conditions, among others. The test protocol used does not require initiation of a fire suppression system at a fixed peak temperature. Instead, the protocol provides a minimum pre-burn time period where the test fire is allowed to freely burn in the fuel pan.

Turning first to the example of the first trace 501 in FIG. 5, the first test event begins with fuel pan ignition around time t=250 sec. The temperature near the first fuel pan 201 rises rapidly to about 675 C and the water discharge system 110 is initiated at about time t=410 sec. Water is discharged until about time t=1150 sec, at which time the temperature near the first fuel pan 201 has dropped to about 275 C. Although the pan temperature is decreased, it does not indicate extinguishment of fire in the first fuel pan 201, that is, the lower (obstructed) pan.

Referring now to the corresponding example of the first trace 601 in FIG. 6, the first test event begins with fuel pan ignition at around time t=250 sec. The temperature near the second fuel pan 202 rises rapidly to about 700 C and the water discharge system 110 is initiated at about time t=410 sec. Water is discharged until about time t=1150 sec, at which time the temperature near the second fuel pan 202 has dropped to about 200 C. Although the pan temperature is decreased, it does not indicate extinguishment of fire in the second fuel pan 202, that is, the upper pan.

In the illustrated example of the first test, the first traces 501 and 601 indicate that a water-only approach to extinguishing the test fires is insufficient to extinguish the fires.

Turning next to the example of the second trace 502 in FIG. 5, the second test event begins with fuel pan ignition around time t=250 sec. The temperature near the first fuel pan 201 rises rapidly to about 800 C and the aerosol system is initiated at about time t=375 sec. Aerosol fire extinguishing particulate matter is discharged until about time t=410 sec, at which time the temperature near the first fuel pan 201 has dropped to about 600 C, but does not indicate extinguishment of fire in the lower (obstructed) pan. The temperature near the first fuel pan 201 continues to drop following the aerosol release, for example because more of the aerosol material contacts the fire and the first fuel pan 201 over time. However, throughout the remainder of the test duration the temperature near the first fuel pan 201 remains at or above about 400 C. indicating that the aerosol agent alone was not sufficient to extinguish the fire.

Referring now to the corresponding example of the second trace 602 in FIG. 6, the second test event begins with fuel pan ignition at around time t=250 sec. The temperature near the second fuel pan 202 rises rapidly to about 600 C and the aerosol system is initiated at about time t=375 sec. Aerosol fire extinguishing particulate matter is discharged until about time t=410 sec, at which time the temperature near the second fuel pan 202 has dropped to about 400 C but does not indicate extinguishment of fire in the upper pan. The temperature near the second fuel pan 202 rises again following the aerosol release, returning to about 600 C or more. The fire dissipates after about time t=600 sec for example when a sufficient amount of the discharged aerosol contacts the fire in the second fuel pan 202.

In the illustrated example of the second test, the second traces 502 and 602 indicate that an aerosol-only extinguisher approach to extinguishing the test fires is insufficient to completely extinguish the obstructed fire in the lower pan, or first fuel pan 201, and is insufficient to rapidly extinguish the shielded fire in the upper or second fuel pan 202.

Turning next to the example of the third trace 503 in FIG. 5, the third test event begins with fuel pan ignition around time t=250 sec. The temperature near the first fuel pan 201 rises rapidly to about 900 C. In the example of FIG. 5, the water discharge system 110 is initiated first at about time t=400 sec (illustrated in FIG. 5 as "HYBRID WATER ON"), and the aerosol system is initiated a brief time later, at about time t=425 sec ("HYBRID AEROSOL ON"). Aerosol particulate matter is discharged until about time t=470 sec ("HYBRID AEROSOL OFF"), at which time the temperature near the first fuel pan 201 has dropped to about 300 C. but does not indicate extinguishment of fire in the lower (obstructed) pan. The temperature near the first fuel pan 201 continues to drop following the aerosol release as more of the aerosol material contacts the fire and the first fuel pan 201. In the example of FIG. 5, the water discharge system 110 is halted around time t=500 sec ("HYBRID WATER OFF") and the fire in the first fuel pan 201 is extinguished at or around the same time. That is, in the example of FIG. 5, the fire events in the first and second tests were not completely extinguished by the water-only and aerosol-only extinguishment attempts, however, the fire event in the third test was rapidly and completely extinguished when the water and aerosol systems were used together.

Referring now to the corresponding example of the third trace 603 in FIG. 6, the third test event begins with fuel pan ignition at around time t=250 sec. The temperature near the second fuel pan 202 rises rapidly to about 700 C. In the present example, the water discharge system 110 is initiated first at about time t=400 sec (illustrated in FIG. 6 as "HYBRID WATER ON"), and the aerosol system is initiated a brief time later, at about time t=425 sec ("HYBRID AEROSOL ON"). Aerosol particulate matter is discharged until about time t=470 sec ("HYBRID AEROSOL OFF"), at which time the temperature near the second fuel pan 202 has dropped to about 450 C, but does not indicate extinguishment of fire in the upper (shielded) pan. The temperature near the second fuel pan 202 continues to drop following the aerosol release as more of the aerosol material contacts the fire and the second fuel pan 202. In the example of FIG. 6, the water discharge system 110 is halted around time t=500 sec ("HYBRID WATER OFF") and the fire in the second fuel pan 202 is extinguished at or around the same time. That is, in the example of FIG. 6, the fire event in the first test was not extinguished until about time t=1200 sec, and the fire event in the second test was not extinguished until about time t=650 sec. The fire event in the third test was more rapidly and completely extinguished, such as by about time t=500 sec, when the water and aerosol systems were used together.

As illustrated in the examples of FIGS. 5 and 6, the third test event indicates that wet and dry agents used together enhanced fire extinguishing performance over use of only one or the other of the wet and dry systems alone. Furthermore, use of the wet system did not cause the aerosol agent to precipitate or reduce an effectiveness of the aerosol agent. The examples of FIGS. 5 and 6 additionally illustrate that the hybrid, or aerosol with water, approach achieves approximately the same extinguishing time for fires in the first and second fuel pans 201 and 202, even though the pans include different size fires and one pan is substantially obstructed.

Various tests involving the gas agent heptafluoropropane, or HFC-227ea, by itself, and using the agent HFC-227ea combined with water, were also performed. HFC-227ea is known to generate a toxic hydrogen fluoride (HF) gas as a byproduct of thermal decomposition when the HFC-227ea agent contacts fire. The production of such a toxic gas can be a significant problem for some applications because of its toxicity to personnel and because it can compromise the ability of fire-fighters to further combat the fire.

In some examples, water is used together with the HFC-227ea agent to help reduce production of the toxic HF gas. However, the use of HFC-227ea agent alone, or HFC-227ea used together with water, was found to continue to result in undesirable levels of toxic gases. The use of the water with this gaseous agent does not improve the fire extinguishing performance of the gaseous agent and the combination with water merely reduces toxic by-products by scrubbing out the HF chemical.

The inventors participated in an independent test program conducted in the same flammable liquid storage test facilities and on the same fires, and found the systems described herein to exhibit superior fire extinguishing performance over systems using HFC-227ea, as detailed by the data presented herein.

Figure 7:
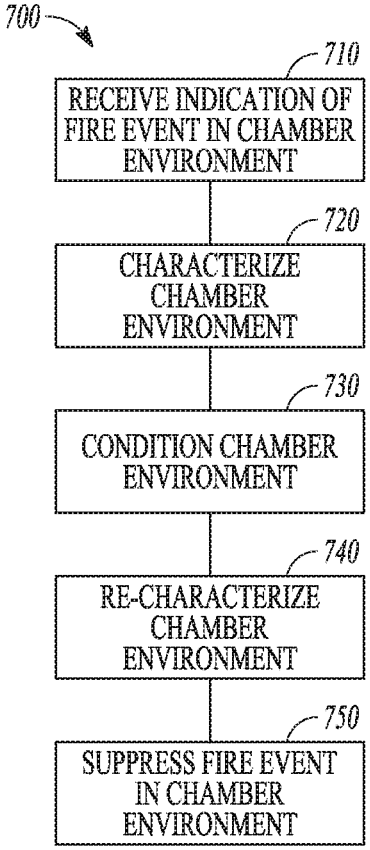
FIG. 7 illustrates generally an example of a block diagram that includes conditioning a chamber environment and suppressing a fire event in the chamber environment.

FIG. 7 illustrates generally an example 700 of a block diagram that includes conditioning a chamber environment and suppressing a fire event in the chamber environment. The chamber environment can include the fire test facility 100 or another, non-test facility, such as an engine room of a marine vessel, a machine room, or other potentially hazardous area.

At operation 710, the example 700 includes receiving an indication of a fire event in a chamber environment. In an example, operation 710 includes receiving information from one or more sensors disposed in the chamber environment. The sensors can include the fire detector 410, such as can include one or more temperature sensors or other sensors configured to provide an indication that a fire exists or is likely to exist inside the chamber environment. In an example, the indication of the fire event in the chamber environment is received by the control circuit 450 at operation 710.

At operation 720, the example 700 optionally includes characterizing the chamber environment. The operation 720 can include analyzing information from one or more sensors to determine where, in a protected area, a fire exists or is likely to exist. In an example, the operation 720 can include determining a temperature profile of, or other initial conditions about, the chamber environment. For example, a temperature profile can include information about temperature differences or gradients throughout the chamber environment.

At operation 730, the example 700 includes conditioning the chamber environment. In an example, operation 730 includes dispensing a liquid mist into the chamber environment. Dispensing the liquid mist can include dispensing water as a mist or vapor, such as using the water discharge actuators 461 and/or water nozzles 462. The dispensed liquid mist can help to reduce temperature stratification throughout at least a portion of the chamber environment by cooling the chamber environment using the dispensed liquid mist.

In an example, operation 730 includes dispensing a specified volume of water or other liquid into the chamber environment to achieve the desired conditioning. In another example, operation 730 includes dispensing water or other liquid into the chamber environment for a specified duration of time to achieve the desired conditioning. In another example, the control circuit 450 can continuously or periodically monitor conditions in the chamber environment, as reported by various sensors, and the control circuit 450 can initiate and terminate the liquid dispensing based on substantially real-time changes in one or more conditions in the chamber environment.

At operation 740, the example 700 includes re-characterizing the chamber environment. Similarly to operation 720, at operation 740 the example can include analyzing information from the same or different one or more sensors to determine characteristics of the chamber environment and how conditions may have changed in response to the conditioning at operation 730. In an example, the operation 740 can include determining again a temperature profile of, or other conditions about, the chamber environment. In an example, the control circuit 450 analyzes the temperatures or temperature profiles collected at operations 720 and 740 to determine an effectiveness of the conditioning or to assess when or whether to initiate release of another fire suppressing agent. In an example, if a temperature profile of the chamber environment indicates less temperature stratification throughout the environment, or a more homogenous temperature environment, then the control circuit 450 can proceed to the following operation of initiating release of a different suppression agent.

At operation 750, the example 700 includes suppressing the fire event in the chamber environment. In an example, the operation 750 includes dispensing an aerosol fire suppression agent into the chamber environment, such as using the aerosol actuators 471. In an example, the operation 750 includes dispensing the aerosol agent when the chamber environment includes at least a portion of the dispensed liquid mist. At operation 750, suppressing the fire event can include diminishing the fire event in the chamber environment using the dispensed aerosol fire suppression agent, and enhancing diminishing the fire event with the cooled chamber environment and the dispensed liquid mist.

Although the example of FIG. 7 includes conditioning at operation 730 that precedes initiation of an aerosol agent release, other examples can include concurrently dispensing liquid, such as water, and aerosol agents into the chamber environment to suppress a fire event.

The wet and dry agent fire extinguishing systems and methods provide various benefits over prior fire extinguisher systems, including over gas-based systems. For example, by reducing a time to extinguishment, the hybrid systems discussed herein can improve life-safety by rapid cooling of a compartment that includes a fire and can allow fire fighters to enter the compartment to rescue people or to fight the fire or stop the fuel for the fire, such as with reduced concern for very high temperatures. The hybrid systems discussed herein can additionally improve life-safety by not including or using a suffocating gas (such as carbon dioxide) as a component of its fire fighting mechanism, and by not being a toxic agent and not having toxic thermal decomposition of the agents (as exists with some gaseous agents).

The wet and dry or hybrid systems described herein can be applied anywhere a dual-agent extinguisher system is practical or feasible. Some possible industrial and commercial applications can include, power generating stations or plants, locomotive engines or other compartments on locomotives, flammable and hazardous materials storage areas, CNC or other machining facilities, switchgear rooms, wind turbines, among others. Some possible marine applications on ships or oil platforms can include engine rooms and engine enclosures, such as for diesel and/or gas turbines, fuel handling areas, battery rooms, switchboard rooms, pump rooms, among others.

In some examples, deploying a hybrid system as described herein may allow certain marine projects to discontinue installation of separate water-based systems over engines and other machinery, which separate systems are sometimes required to allow crew to escape or to fight fire before actuation of a main extinguishing system, such as could use toxic or suffocating gas agents. Such systems to be discontinued have been commonly referred to as "913" systems and were originally defined by the International Maritime Organization's regulation MSC/Circ.913. Some systems that locally apply water over the most likely sources of fire in marine machinery spaces are intended to be operated before all personnel have evacuated the compartment that is on fire. The systems discussed herein can be initiated before personnel have fully evacuated a space because the wet and dry agents are non-toxic. In addition, a system employing the wet and dry agents as discussed herein can provide protection over an entire space rather than just over selected locations (e.g., over engines and other machinery), as discussed above and as illustrated by the test data including for obstructed and non-obstructed fires.

Various Notes

The following Aspects provide a non-limiting overview of the fire suppression systems, system components, and fire suppression methods discussed herein.

Aspect 1 can include or use subject matter (such as an apparatus, a system, a device, a method, a means for performing acts, or a device readable medium including instructions that, when performed by the device, can cause the device to perform acts), such as can include or use a method for suppressing a fire event in a chamber, the method comprising conditioning a chamber environment having a fire event. In Aspect 1, conditioning the chamber environment can include dispensing a liquid mist into the chamber environment, and reducing temperature stratification throughout at least a portion of the chamber environment by cooling the chamber environment using the dispensed liquid mist. Aspect 1 can further include suppressing the fire event in the chamber environment. Suppressing the fire event can include dispensing an aerosol fire suppression agent into the chamber environment when the chamber environment includes at least a portion of the dispensed liquid mist, diminishing the fire event in the chamber environment using the dispensed aerosol fire suppression agent, and enhancing diminishing the fire event with the cooled chamber environment and the dispensed liquid mist.

Aspect 2 can include or use, or can optionally be combined with the subject matter of Aspect 1, to optionally include or use suppressing the fire event in the chamber environment by dispensing the liquid mist into the chamber environment concurrently with dispensing the aerosol fire suppression agent into the chamber environment.

Aspect 3 can include or use, or can optionally be combined with the subject matter of one or any combination of Aspects 1 or 2 to optionally include the chamber, and the chamber comprises one or more of an engine compartment (in an example, on a marine vessel or another vessel or land-based compartment), a pump room (in an example, on a marine vessel or another vessel or land-based room), and a fuel processing compartment (in an example, on a marine vessel or another vessel or land-based compartment).

Aspect 4 can include or use, or can optionally be combined with the subject matter of one or any combination of Aspects 1 through 3 to optionally include receiving, at a control circuit, an indication of a fire presence or an elevated temperature in the chamber, and in response to receiving the indication of the fire presence or the elevated temperature in the compartment (1) using the control circuit, actuating a first valve to initiate the dispensing the liquid mist into the chamber environment, and (2) using the control circuit, actuating a second valve to initiate the dispensing the aerosol fire suppression agent into the chamber environment.

Aspect 5 can include or use, or can optionally be combined with the subject matter of Aspect 4, to optionally include, in response to receiving the indication of the fire presence or the elevated temperature in the compartment, initiating a timer circuit and actuating the second valve when the timer circuit indicates that a specified delay is elapsed. In Aspect 5, dispensing the liquid mist into the chamber environment would not occur concurrently with dispensing the aerosol fire suppression agent into the chamber environment, contrary to Aspect 2.

Aspect 6 can include or use, or can optionally be combined with the subject matter of one or any combination of Aspects 1 through 5 to optionally include receiving, at a control circuit, information about a temperature in the chamber environment and, based on the information about the temperature in the chamber environment, initiating the dispensing the aerosol fire suppression agent into the chamber environment.

Aspect 7 can include or use, or can optionally be combined with the subject matter of one or any combination of Aspects 1 and Aspects 3 through 6 to optionally include, before dispensing the liquid mist, measuring a first temperature in the chamber environment, and after dispensing a first volume of liquid mist into the chamber environment, measuring a second temperature in the chamber environment. If the second temperature is less than the first temperature by at least a specified threshold temperature difference amount, then Aspect 7 can include initiating the dispensing the aerosol fire suppression agent into the chamber environment.

Aspect 8 can include or use, or can optionally be combined with the subject matter of one or any combination of Aspects 1 and Aspects 3 through 7 to optionally include, before dispensing the liquid mist, determining a first temperature profile for the chamber environment using temperature information measured at multiple elevations in the chamber, and after dispensing a first volume of liquid mist into the chamber environment, determining a second temperature profile for the chamber environment using temperature information measured at multiple elevations in the chamber. If the second temperature profile indicates a more homogenous temperature profile for the compartment than the first temperature profile, then Aspect 8 can include initiating the dispensing the aerosol fire suppression agent into the chamber environment.

Aspect 9 can include or use, or can optionally be combined with the subject matter of one or any combination of Aspects 1 through 8 to optionally include dispensing the liquid mist into the chamber environment includes dispensing water droplets that have an average droplet diameter of greater than about 200 μm.

Aspect 10 can include or use, or can optionally be combined with the subject matter of one or any combination of Aspects 1 through 8 to optionally include dispensing the liquid mist into the chamber environment includes dispensing water droplets that have an average droplet diameter of about 200 μm or less.

Aspect 11 can include or use, or can optionally be combined with the subject matter of one or any combination of Aspects 1 through 10 to optionally include dispensing the aerosol fire suppression agent into the chamber environment includes dispensing fire extinguishing particulates that have an average particulate diameter of about 200 μm or less.

Aspect 12 can include or use, or can optionally be combined with the subject matter of one or any combination of Aspects 1 through 10 to optionally include dispensing the aerosol fire suppression agent into the chamber environment includes dispensing fire extinguishing particulates that have an average particulate diameter of about 5 μm or less.

Aspect 13 can include or use, or can optionally be combined with the subject matter of one or any combination of Aspects 1 through 12 to optionally include dispensing the aerosol fire suppression agent into the chamber environment includes actuating one or more of a condensed aerosol generator or a dispersed aerosol device to produce the aerosol fire suppression agent.

Aspect 14 can include or use, or can optionally be combined with the subject matter of one or any combination of Aspects 1 through 13 to optionally include dispensing the liquid mist into the chamber environment includes dispensing one or more of fresh water, sea water, de-ionized water, purified water, water with impurities, or water mixed with one or more additives to inhibit freezing of the water to be dispensed.

Aspect 15 can include or use, or can optionally be combined with the subject matter of one or any combination of Aspects 1 through 14 to optionally include dispensing the liquid mist into the chamber environment includes dispensing a liquid with one or more additives including a firefighting foam concentrate, wetting agent, or chemical sealant configured to seal a fuel surface from air to prevent re-flash.

Aspect 16 can include, or can optionally be combined with the subject matter of one or any combination of Aspects 1 through 15 to include or use, subject matter (such as an apparatus, a method, a means for performing acts, or a machine readable medium including instructions that, when performed by the machine, that can cause the machine to perform acts), such as can include or use a system for suppressing a fire event in a chamber. In Aspect 16, the system can include a spray or mist generator configured to dispense a liquid mist to condition a chamber environment of the chamber, wherein the spray or mist generator includes one or more nozzles in communication with a liquid reservoir, and a control valve interposed between the one or more mist nozzles and the liquid reservoir. In Aspect 16, the system can include an aerosol generator configured to dispense an aerosol fire suppression agent into the chamber environment of the chamber, wherein the aerosol generator includes an initiator configured to begin dispensing of the aerosol fire suppression agent into the chamber environment. In Aspect 16, the system can further include a controller in communication with the control valve and the initiator, the controller configured to coordinate conditioning the chamber environment using the liquid mist and dispensing the aerosol fire suppression agent into the chamber environment using the initiator.

Aspect 17 can include or use, or can optionally be combined with the subject matter of Aspect 16, to optionally include or use the controller configured to receive activity information from the aerosol generator and in response control the control valve to initiate or inhibit dispensing the liquid mist.

Aspect 18 can include or use, or can optionally be combined with the subject matter of one or any combination of Aspects 16 or 17 to optionally include or use the aerosol generator including at least one aerosol pellet including a fire suppression aerosol-forming compound, one or more discharge ports in communication with the at least one aerosol pellet, and the initiator configured to begin generation of the aerosol fire suppression agent from the at least one aerosol pellet.

Aspect 19 can include or use, or can optionally be combined with the subject matter of one or any combination of Aspects 16 through 18 to optionally include or use an aerosol generator that includes a dispersed aerosol tank containing aerosol particles, one or more aerosol discharge nozzles in communication with the at least one tank and configured to discharge the aerosol particles, and a propellant gas for the aerosol particles in the tank.

Aspect 20 can include or use, or can optionally be combined with the subject matter of one or any combination of Aspects 16 through 19 to optionally include or use the controller configured to coordinate dispensing the aerosol fire suppression agent into the chamber environment when the chamber environment includes the liquid mist.

Aspect 21 can include or use, or can optionally be combined with the subject matter of one or any combination of Aspects 16 through 20 to optionally include or use the controller configured to inhibit dispensing the aerosol fire suppression agent and permit dispensing the liquid mist until a specified first condition is satisfied, and when the first condition is satisfied, permit dispensing the aerosol fire suppression agent from the at least one aerosol generator.

Aspect 22 can include or use, or can optionally be combined with the subject matter of Aspect 21, to optionally include the first condition being one of (1) dispensing a specified first volume of water using the one or more mist nozzles, (2) dispensing the liquid mist into the chamber environment for a specified first duration, and (3) a temperature change in the chamber environment as detected by a sensor.

Aspect 23 can include or use, or can optionally be combined with the subject matter of one or any combination of Aspects 16 through 22 to optionally include or use the controller configured to coordinate dispensing the aerosol fire suppression agent into the chamber environment concurrently with dispensing the liquid mist.

Aspect 24 can include or use, or can optionally be combined with the subject matter of one or any combination of Aspects 16 through 23 to optionally include or use one or more temperature sensors (e.g., one or more thermocouples) provided in the first compartment. In Aspect 24, the controller can be coupled to the one or more temperature sensors and the controller is configured to use information from one or more of the temperature sensors to coordinate the dispensing the liquid mist and the dispensing the aerosol fire suppression agent.

Aspect 25 can include or use, or can optionally be combined with the subject matter of one or any combination of Aspects 16 through 24 to optionally include or use the aerosol generator configured to discharge fire extinguishing particulates that have an average particulate diameter of about 5 μm or less.

Aspect 26 can include or use, or can optionally be combined with the subject matter of one or any combination of Aspects 16 through 25 to optionally include or use the aerosol generator comprising at least one of a condensed aerosol generator, a pyrotechnic generator, and a dispersed aerosol device. In an example, at least one aerosol generator can include a grenade-style device that can be manually or automatically activated.

Aspect 27 can include, or can optionally be combined with the subject matter of one or any combination of Aspects 1 through 26 to include or use, subject matter (such as an apparatus, a method, a means for performing acts, or a machine readable medium including instructions that, when performed by the machine, that can cause the machine to perform acts), such as can include or use a fire suppression system configured to introduce different fire suppression agents into a chamber environment at respective times. In an example, Aspect 27 includes one or more nozzles configured to release water into the chamber environment, each nozzle having a respective nozzle valve that controls a release of the water by the one or more nozzles, and one or more aerosol dispensers configured to release an aerosol fire suppression agent into the chamber environment, each aerosol dispenser having an initiator to trigger a release of the aerosol fire suppression agent by the one or more aerosol dispensers. In an example, Aspect 27 further includes a controller configured to, in response to a fire event, (1) actuate the one or more nozzle valves to initiate release of the water at a first time to condition the chamber environment, and (2) actuate the one or more aerosol initiators to trigger release of the aerosol first suppression agent at a second time to suppress the fire event.

Aspect 28 can include or use, or can optionally be combined with the subject matter of Aspect 27, to optionally include the first time precedes the second time.

Aspect 29 can include or use, or can optionally be combined with the subject matter of Aspect 27, to optionally include the first time and the second time are substantially the same time and the controller is configured to actuate the one or more nozzle valves and actuate the one or more aerosol initiators substantially concurrently.

Aspect 30 can include or use, or can optionally be combined with the subject matter of one or more of Aspects 27 through 29 to optionally include or use an environment sensor coupled to the controller and configured to sense environment characteristic information about the chamber environment. In Aspect 30, the controller is configured to time actuation of one or both of the nozzle valves and the aerosol initiators based on the environment characteristic information.

Each of these non-limiting Aspects can stand on its own, or can be combined in various permutations or combinations with one or more of the other Aspects and examples discussed herein.

The above description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods, such as fire extinguishment control system methods, as described in the above examples, such as to initiate release of an extinguishing agent from a water-based or aerosol-based system. In an example, the instructions can include instructions to receive sensor data from one or more sensors in or near a protect environment and, based on the sensor data, initiate the agent release. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A method for suppressing a fire event in a chamber, the method comprising:

conditioning a chamber environment having a fire event, conditioning the chamber environment includes:

dispensing a flame suppressing liquid into the chamber environment, the dispensing including using a controller to actuate, at a first time, one or more nozzles configured to release the flame suppressing liquid into the chamber environment, each nozzle having a respective nozzle valve that controls release of the flame suppressing liquid by the one or more nozzles, and the dispensing the flame suppressing liquid changing a temperature condition in the chamber environment using the flame suppressing liquid; and suppressing the fire event in the chamber environment, suppressing the fire event includes:

actuating one or more aerosol initiators for one or more aerosol dispensers, the actuating including using the controller to trigger release of an aerosol fire suppression agent at a second time, following the first time, to suppress the fire event, wherein the one or more aerosol dispensers are configured to release the aerosol fire suppression agent and a gaseous carrier component for the aerosol fire suppression agent into the chamber environment, and wherein each aerosol dispenser comprises at least one of the aerosol initiators to trigger release of the aerosol fire suppression agent and the gaseous carrier component.

2. The method of claim 1, wherein the suppressing the fire event in the chamber environment further comprises dispensing the flame suppressing liquid into the chamber environment concurrently with dispensing the aerosol fire suppression agent into the chamber environment.

3. The method of claim 1, wherein the chamber comprises one or more of an engine compartment, a pump room, and a fuel processing compartment.

4. The method of claim 1, further comprising:

receiving, at a control circuit of the controller, an indication of a fire presence or an elevated temperature in the chamber; and in response to receiving the indication of the fire presence or the elevated temperature in the compartment:

using the control circuit, actuating one or more of the nozzle valves corresponding to the one or more nozzles to initiate the dispensing the flame suppressing liquid into the chamber environment; and using the control circuit, actuating the one or more aerosol initiators to trigger the release of the aerosol fire suppression agent into the chamber environment.

5. The method of claim 1, further comprising:

receiving, at a control circuit of the controller, information about a temperature in the chamber environment; and based on the information about the temperature in the chamber environment, initiating the actuation of the one or more aerosol initiators to thereby release the aerosol fire suppression agent into the chamber environment.

6. The method of claim 1, further comprising:

before dispensing the flame suppressing liquid, measuring a first temperature in the chamber environment;

after dispensing a first volume of the flame suppressing liquid into the chamber environment, measuring a second temperature in the chamber environment; and if the second temperature is less than the first temperature by at least a specified threshold temperature difference amount, then initiating the actuation of the one or more aerosol initiators to thereby release the aerosol fire suppression agent into the chamber environment.

7. The method of claim 1, wherein the dispensing the flame suppressing liquid into the chamber environment includes dispensing water droplets that have an average droplet diameter of about 200 μm or less.

8. The method of claim 1, wherein the suppressing the fire event includes using the aerosol dispensers to release fire extinguishing particulates that have an average particulate diameter of about 5 μm or less.

9. A system for suppressing a fire event in a chamber, the system comprising:

a spray or mist generator configured to dispense a liquid mist extinguisher to change a temperature condition of a chamber environment of the chamber, wherein the spray or mist generator includes:

one or more mist nozzles, in communication with a liquid reservoir, and configured to release the liquid mist extinguisher into the chamber environment of the chamber; and a control valve interposed between the one or more mist nozzles and the liquid reservoir;

an aerosol generator including one or more discharge ports or one or more aerosol discharge nozzles configured to dispense an aerosol fire suppression agent and a gaseous carrier component for the aerosol fire suppression agent, from the aerosol generator, into the chamber environment of the chamber, wherein the aerosol generator includes an initiator configured to begin dispensing of the aerosol fire suppression agent and the gaseous carrier component into the chamber environment; and a controller in communication with the control valve and the initiator, the controller configured to coordinate conditioning the chamber environment using the liquid mist extinguisher and dispensing the aerosol fire suppression agent and the gaseous carrier component into the chamber environment using the initiator.

10. The system of claim 9, wherein the aerosol generator includes:

at least one aerosol pellet including a fire suppression aerosol-forming compound, the one or more discharge ports in communication with the at least one aerosol pellet, and the initiator configured to begin generation of the aerosol fire suppression agent from the at least one aerosol pellet.

11. The system of claim 9, wherein the aerosol generator includes:

a dispersed aerosol tank containing aerosol particles;

the one or more aerosol discharge nozzles in communication with the dispersed aerosol tank and configured to discharge the aerosol particles; and the gaseous carrier component for the aerosol particles in the dispersed aerosol tank.

12. The system of claim 9, wherein the controller is configured to coordinate dispensing the aerosol fire suppression agent into the chamber environment when the chamber environment includes the liquid mist extinguisher.

13. The system of claim 9, wherein the controller is configured to:

inhibit dispensing the aerosol fire suppression agent and permit dispensing the liquid mist extinguisher until a specified first condition is satisfied; and when the first condition is satisfied, permit dispensing the aerosol fire suppression agent from the aerosol generator.

14. The system of claim 13, wherein the first condition includes one of:

dispensing a specified first volume of the liquid mist extinguisher using the one or more mist nozzles; and dispensing the liquid mist extinguisher into the chamber environment for a specified first duration; and a temperature change in the chamber environment as detected by a sensor.

15. The system of claim 9, wherein the controller is configured to coordinate dispensing the aerosol fire suppression agent into the chamber environment concurrently with dispensing the liquid mist extinguisher.

16. The system of claim 9, further comprising one or more temperature sensors configured to detect a temperature change in the chamber environment; and wherein the controller is coupled to the one or more temperature sensors and the controller is configured to use information from the temperature sensors to coordinate the dispensing the aerosol fire suppression agent in response to the temperature change in the chamber environment and in response to the conditioning the chamber environment using the liquid mist extinguisher.

17. A fire suppression system configured to introduce different fire suppression agents into a chamber environment at respective times, the system comprising:

one or more nozzles configured to release a flame suppressing liquid into the chamber environment, each nozzle having a respective nozzle valve that controls a release of the flame suppressing liquid by the one or more nozzles;

one or more aerosol dispensers configured to release an aerosol fire suppression agent and a gaseous carrier component for the aerosol fire suppression agent into the chamber environment, each aerosol dispenser having an initiator to trigger a release of the aerosol fire suppression agent and the gaseous carrier component by the one or more aerosol dispensers; and a controller configured to, in response to a fire event:

actuate the one or more nozzle valves to initiate release of the flame suppressing liquid at a first time to change a temperature condition in the chamber environment using the flame suppressing liquid, and actuate the one or more aerosol initiators to trigger release of the aerosol fire suppression agent and the gaseous carrier component at a second time, following the first time, to suppress the fire event.

18. The fire suppression system of claim 17, further comprising an environment sensor coupled to the controller and configured to sense environment characteristic information about the chamber environment, and wherein the controller is configured to time actuation of one or both of the nozzle valves and the aerosol initiators based on the environment characteristic information.

19. The system of claim 13, wherein the first condition includes a temperature change in the chamber environment as detected by a sensor.

20. The fire suppression system of claim 18, wherein the environment sensor comprises a temperature sensor configured to sense a temperature characteristic in the chamber environment.

* * * * *